US011527852B2

(12) United States Patent
Kim

(10) Patent No.: US 11,527,852 B2
(45) Date of Patent: Dec. 13, 2022

(54) SEPARABLE HIGH-VOLTAGE CONNECTOR ASSEMBLY AND MANUFACTURING METHOD THEREFOR

(71) Applicant: LG Chem, Ltd., Seoul (KR)

(72) Inventor: Jeong Wan Kim, Daejeon (KR)

(73) Assignee: LG Energy Solution, Ltd.

( * ) Notice: Subject to any disclaimer, the term of this patent is extended or adjusted under 35 U.S.C. 154(b) by 0 days.

(21) Appl. No.: 16/626,058

(22) PCT Filed: Jan. 18, 2019

(86) PCT No.: PCT/KR2019/000760
§ 371 (c)(1),
(2) Date: Dec. 23, 2019

(87) PCT Pub. No.: WO2019/143178
PCT Pub. Date: Jul. 25, 2019

(65) Prior Publication Data

US 2020/0412059 A1 Dec. 31, 2020

(30) Foreign Application Priority Data

Jan. 19, 2018 (KR) ..... 10-2018-0006972

(51) Int. Cl.
*H01R 13/642* (2006.01)
*H01R 12/70* (2011.01)
(Continued)

(52) U.S. Cl.
CPC ..... *H01R 13/642* (2013.01); *H01R 12/7088* (2013.01); *H01R 13/04* (2013.01);
(Continued)

(58) Field of Classification Search
CPC .. H01R 13/41; H01R 13/4223; H01R 13/113; H01R 27/7073; H01R 13/642;
(Continued)

(56) References Cited

U.S. PATENT DOCUMENTS 6,280,206 B1 8/2001 Kuroda et al.
7,591,654 B2 * 9/2009 Neumetzler ..... H01R 12/515 439/79
(Continued)

FOREIGN PATENT DOCUMENTS

CN 2731748 Y 10/2005
CN 101378160 A 3/2009
(Continued)

OTHER PUBLICATIONS

International Search Report for Application No. PCT/KR2019/000760, dated Apr. 24, 2019, pp. 1-3.
(Continued)

*Primary Examiner* — Gary F Paumen
(74) *Attorney, Agent, or Firm* — Lerner, David, Littenberg, Krumholz & Mentlik, LLP

(57) ABSTRACT

A separable high-voltage connector assembly which can miniaturize a size by individually separating each first pin of a connector mounted on a board to form multiple small connectors and simplify a process and prevent an error that connectors are incorrectly inserted into each other by forming an inserting connector through fastening and assembling each of individually separated second pins.

8 Claims, 3 Drawing Sheets

(51) Int. Cl.
*H01R 13/04* (2006.01)
*H01R 13/42* (2006.01)
*H01R 13/53* (2006.01)
*H01R 43/18* (2006.01)

(52) U.S. Cl.
CPC ..... *H01R 13/42* (2013.01); *H01R 13/53* (2013.01); *H01R 43/18* (2013.01); *H01R 2201/26* (2013.01)

(58) Field of Classification Search
CPC ..... H01R 13/04; H01R 13/42; H01R 13/53; H01R 12/7088; H01R 43/18; H01R 2201/26
USPC ..... 439/733.1, 752.5, 79
See application file for complete search history.

(56) References Cited

U.S. PATENT DOCUMENTS

| | | | | |
|---|---|---|---|---|
| 7,922,496 | B2 * | 4/2011 | Liu | H01R 31/005 439/65 |
| 2003/0176103 | A1 | 9/2003 | Sakamoto et al. | |
| 2011/0124218 | A1 | 5/2011 | Huang | |
| 2011/0183551 | A1 | 7/2011 | Hirano | |
| 2012/0225594 | A1 * | 9/2012 | Hsieh | H01R 12/716 439/733.1 |
| 2015/0056868 | A1 | 2/2015 | Goossens | |
| 2015/0340810 | A1 * | 11/2015 | Shi | H01R 13/639 439/345 |
| 2016/0111804 | A1 * | 4/2016 | Saito | H01R 13/18 439/733.1 |
| 2016/0156119 | A1 | 6/2016 | Lee et al. | |

FOREIGN PATENT DOCUMENTS

| | | | |
|---|---|---|---|
| CN | 201725926 | U | 1/2011 |
| CN | 102163774 | A | 8/2011 |
| CN | 204376002 | U | 6/2015 |
| EP | 1006617 | A2 | 6/2000 |
| EP | 1835571 | A2 | 9/2007 |
| JP | H07106022 | A | 4/1995 |
| JP | 2001297833 | A | 10/2001 |
| JP | 2009252669 | A | 10/2009 |
| KR | 960025637 | U | 7/1996 |
| KR | 20000035759 | A | 6/2000 |
| KR | 20000039056 | A | 7/2000 |
| KR | 20040038479 | A | 5/2004 |
| KR | 20110009902 | A | 1/2011 |
| KR | 20120138661 | A | 12/2012 |
| KR | 20160066182 | A | 6/2016 |
| KR | 101704255 | B1 | 2/2017 |
| KR | 20170028209 | A | 3/2017 |
| KR | 101734249 | B1 | 5/2017 |
| KR | 20170059852 | A | 5/2017 |

OTHER PUBLICATIONS

Extended European Search Report for Application No. EP19741910.4 dated Jun. 23, 2020, 3 pgs.
Chinese Search Report for Application No. CN201980002642.6 dated Aug. 4, 2020, 2 pages.
Chinese Search Report for Application No. 201980002642.6, dated Apr. 19, 2021,10 pages.

* cited by examiner

[Figure 1]

SEPARABLE HIGH-VOLTAGE CONNECTOR ASSEMBLY AND MANUFACTURING METHOD THEREFOR

CROSS-REFERENCE TO RELATED APPLICATIONS

The present application is a national phase entry under 35 U.S.C. § 371 of International Application No. PCT/KR2019/000760 filed Jan. 18, 2019, published in Korean, which claims priority from Korean Patent Application No. 10-2018-0006972 filed Jan. 19, 2018, all of which are incorporated herein by reference.

TECHNICAL FIELD

The present invention relates to a separable high-voltage connector assembly, and more particularly, to a detachable high-voltage connector assembly which can miniaturize a size by individually separating each first pin of a connector mounted on a board to form multiple small connectors and simplify a process and prevent an error that connectors are incorrectly inserted into each other by forming an inserting connector through fastening and assembling each of individually separated second pins, and a manufacturing method thereof.

BACKGROUND ART

In the case of generally used low-voltage connectors, as a battery capacity increases in the battery related electric fields such as energy storage systems (ESS) and electric vehicles, management devices require increasingly higher voltages.

However, since the low voltage connector cannot be operated in a high-voltage environment at present, a gap between second pins (male pins) must be ensured at a predetermined distance or more, the size of the low-voltage connector cannot but be increased.

Meanwhile, in the related art, in order overcome a limitation in connector size, multiple connectors are used and since it is necessary to consider fool proof, it is difficult to supply and demand various kinds of connectors and even though multiple connectors are used, there is a mistake that the second pin and a first pin of the connector are mistakenly inserted.

Therefore, in order to solve the limitations and the problems associated with high voltage requirements required in the low-voltage connector in the related art, the present inventor has developed a separable high-voltage connector assembly which can miniaturize a size by individually separating each first pin of a connector mounted on a board to form multiple small connectors and simplify a process and prevent an error that connectors are incorrectly inserted into each other by forming an inserting connector through fastening and assembling each of individually separated second pins, and a manufacturing method thereof.

SUMMARY OF THE INVENTION

Technical Problem

The present invention is contrived to solve the problems and has been made in an effort to provide a separable high-voltage connector assembly, and more particularly, to a separable high-voltage connector assembly which can miniaturize a size by individually separating each first pin of a connector mounted on a board to form multiple small connectors and simplify a process and prevent an error that connectors are incorrectly inserted into each other by forming an inserting connector through fastening and assembling each of individually separated second pins, and a manufacturing method thereof.

Technical Solution

A separable high-voltage connector assembly according to an embodiment of the present invention includes: a plurality of first pins; and a connector including a plurality of second pins, each second pin fastened to a corresponding one of the plurality first pins, in which the connector may be integrally formed through fastening and assembling of the respective second pins.

In an embodiment, a key code may be applied to each of the plurality of first pins.

In an embodiment, the connector may include a connector body, and each of the second pins may be fastened and assembled to the connector body.

In an embodiment, the connector body may include a plurality of fastening grooves arranged in the connector body at predetermined intervals and a creepage and a clearance for each of the second pins may be configured to be adjusted as the respective second pins are fastened and assembled to the plurality of fastening grooves.

In an embodiment, each of the second pins may be one pin.

In an embodiment, each of the plurality first pins may be one or more pins.

In an embodiment, each of the plurality of first pins may be a female pin configured to receive the corresponding second pin or a male pin configured to be inserted into the corresponding second pin.

In an embodiment, each of the respective second pins may be a female pin configured to receive the corresponding first pin or a male pin configured to be inserted into the multiple first pins.

A manufacturing method of a separable high-voltage connector assembly according to another embodiment of the present invention may include: mounting a plurality of first pins on a board; fastening a connector including a plurality of second pins to corresponding one of the plurality of first pins; and integrally forming the connector through fastening and assembling of the respective second pins.

In an embodiment, the integrally forming of the connector through fastening and assembling of the respective second pins may include fastening and assembling each of the second pins to a connector body.

In an embodiment, the integrally forming of the connector through fastening and assembling of the respective second pins may include arranging a plurality of fastening grooves in the connector body at predetermined intervals, and adjusting a creepage and a clearance for the respective second pins as the respective second pins are fastened and assembled to the plurality of fastening grooves.

In an embodiment, each of the second pins may be one pin and the fastening of the connector through the connector including respective second pins to the plurality of first pins may include fastening the one pin of each of the second pins to the corresponding first pins.

In an embodiment, each of the plurality of first pins may be one or more pins, and the mounting of the plurality of first pins on the board may include mounting the one or more pins of each of the plurality of first pins on the board.

Advantageous Effects

According to an aspect of the present invention, it is possible to miniaturize a size by individually separating each first pin of a connector mounted on a board to form multiple small connectors and simplify a process and prevent an error that connectors are incorrectly inserted into each other by forming an inserting connector through fastening and assembling each of individually separated second pins.

DETAILED DESCRIPTION OF THE DRAWINGS

Hereinafter, a preferred embodiment is presented in order to assist understanding of the present invention. However, the following embodiment is just provided to more easily understand the present invention and contents of the present invention are not limited by the embodiment.

Figure 1:
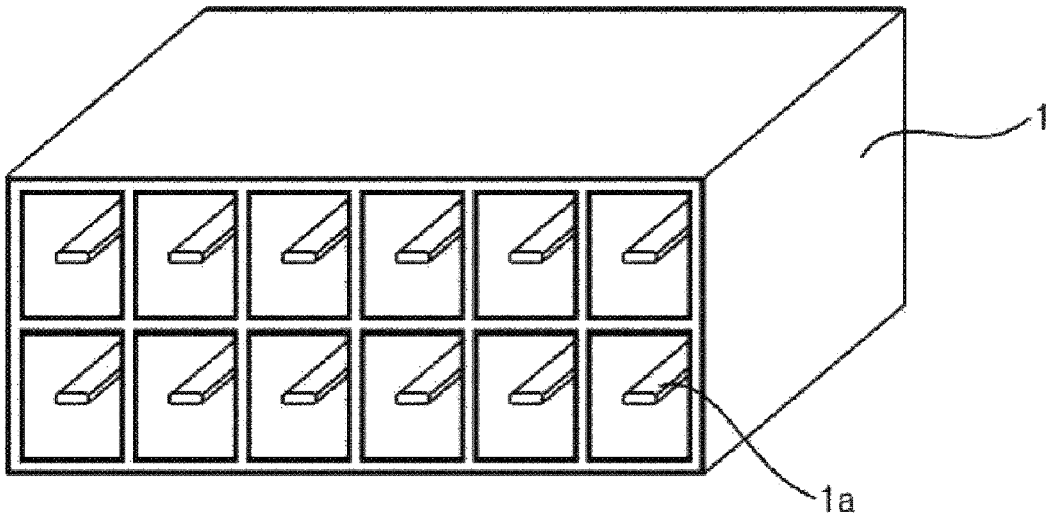
FIG. 1 is a diagram schematically illustrating a shape of a female connector 1 in the related art.

FIG. 1 is a diagram schematically illustrating a shape of a female connector 1 in the related art.

Referring to FIG. 1, it can be seen that the female connector 1 in the related art is a structure in which respective first pins 1*a* are arranged at a regular interval in one integral housing as illustrated in FIG. 1.

This is a structure that cannot be downsized due to characteristics of the integral housing and has a problem that an unnecessary extra connector pin is generated.

In particular, in the female connector 1 in the related art, since each first pin 1*a* protrudes from an inner surface and a voltage value to be conducted corresponds to low voltage, it is not necessary to secure a wide pin interval.

However, as a battery capacity in an electric industry related to a battery such as an energy storage system (ESS) and an electric automobile is increased, the connector is gradually required to have high voltage and a high-voltage operation may not be performed through the female connector 1 in the related art and to this end, there is a problem that the pin interval should be ensured while enlarging an overall size of the female connector 1 in the related art.

Therefore, in the present invention, a separable high-voltage connector assembly 100 will be described, which is capable of securing the pin interval without enlarging the overall size of the low-voltage connector 1.

Figure 2:
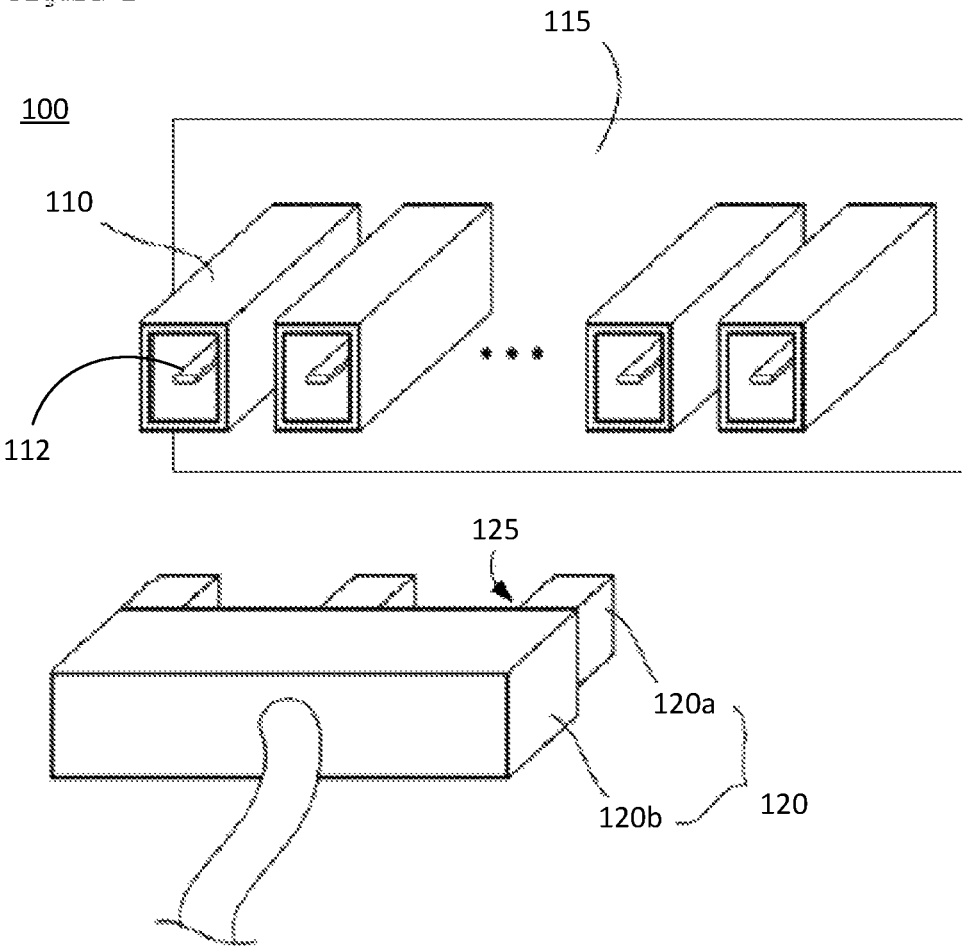
FIG. 2 is a diagram schematically illustrating a configuration of a separable high-voltage connector assembly 100 according to an embodiment of the present invention.

FIG. 2 is a diagram schematically illustrating a configuration of a separable high-voltage connector assembly 100 according to an embodiment of the present invention.

Referring to FIG. 2, the separable high-voltage connector assembly 100 according to an embodiment of the present invention may be configured to generally include multiple first (female) pins 112 and male connectors 120 mounted on a board 115.

The multiple first (female) pins 112 may refer to a small connector having a similar function to the female connector 1 in the related art, which is illustrated in FIG. 1, which may refer to a kind of female connector made of one or more pins, respectively.

Further, as the key code is granted to each of the multiple first pins 112, an insertion location of a second pin 120*a* of the connector 120 to be described below is determined according to a designated key code.

The connector 120 includes second (male) pins 120*a* fastened to the multiple first (female) pins 112, respectively and a connector body 120*b* and as the respective second (male) pins 120*a* are fastened and assembled to the connector body 120*b*, the connector 120 is formed as one integral body. Such a connector 120 may refer to, for example, a male connector. However, the present invention is not limited thereto and the multiple first (female) pins 112 and the connector 120 may be applied by changing roles of the female and the male. The separable high-voltage connector assembly 100 according to an embodiment of the present invention may be manufactured in a shape of a female pin in which the multiple first pins are inserted by the respective second pins or a shape of a male pin to be inserted into the respective second pins. Further, the respective second pins may be manufactured in the shape of the female pin inserted by the multiple first pins or the shape of the male pin to be inserted into the multiple first pins.

More specifically, the multiple fastening grooves (125) to which the respective second pins 120*a* are to be fastened and assembled may be arranged in the connector body 120*b* at a predetermined interval and as the respective second pins 120*a* are fastened and assembled to the multiple fastening grooves 125, a creepage and a clearance for each second pin 120*a* may be adjusted.

As each pin 120*a* is manufactured by one pin, the process of the connector 120 may be simplified and since each second pin 120*a* may be assembled to the connector body 120*b*, the multiple first pins 112 may be handled by correspondingly increasing the number of second pins 120*a*.

Here, the creepage may refer to a total distance between terminals provided inside each of the multiple first pins 112 and in this case, the total distance may refer to a distance including a diameter and a size of a housing 110 (or outer shape) of each first pin 112.

Further, the clearance may refer to a linear distance between terminals provided inside each of the multiple first pins 112 and in this case, the linear distance refers to just a shortest distance between the terminals disregarding the housing 110 (or outer shape) of each first pin 112.

As a result, in the separable high-voltage connector assembly 100 according to an embodiment of the present invention, the connector mounted on the board 115 is separated into multiple miniaturized small connectors 112, 114 and the inserted connector is formed in an assembly type in which multiple second pins may be assembled and fastened to the connector, thereby simplifying the process and preventing even an error that the connectors are inserted into each other incorrectly.

Next, a manufacturing and fastening process of the separable high-voltage connector assembly 100 will be described with reference to FIG. 3.

Figure 3:
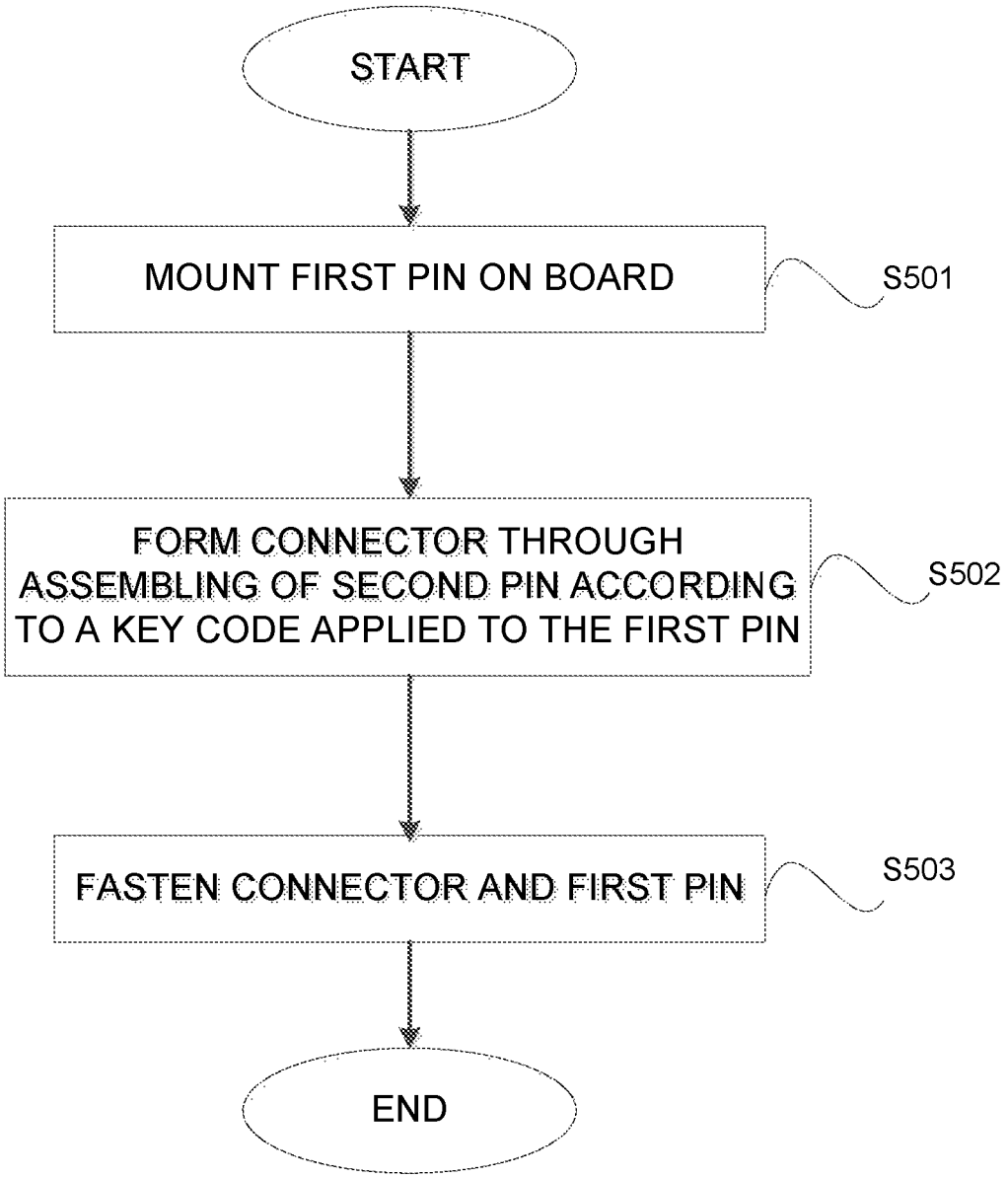
FIG. 3 is a flowchart for describing a process of manufacturing and fastening a separable high-voltage connector assembly 100 according to an embodiment of the present invention.

FIG. 3 is a flowchart for describing a process of manufacturing and fastening a separable high-voltage connector assembly 100 according to an embodiment of the present invention.

First, each of multiple first pins is manufactured by one or more pins, which are mounted on the board (S501).

Next, the connector is integrally formed through fastening and assembling of respective second pins and multiple fastening grooves to which the respective second pins are to be fastened and assembled are arranged in a body of the connector at a predetermined interval and as the respective second pins are fastened and assembled to the multiple fastening grooves, a creepage and a clearance for the each second pin are adjusted (S502).

Next, the connector is fastened with multiple first pins through the respective second pins fastened and assembled to the body of the connector (S503).

The present invention has been described with reference to the preferred embodiments of the present invention, but those skilled in the art will understand that the present invention can be variously modified and changed without departing from the spirit and the scope of the present invention which are defined in the appended claims.

The invention claimed is:

1. A separable high-voltage connector assembly comprising:

a first connector including at least three small connectors, wherein each small connector includes only one first pin and a respective housing surrounding the first pin, and wherein each small connector is configured to be separately connectable to a board, and wherein none of the respective housings of the small connectors are in physical contact with each other; and a second connector including a plurality of second pins, each second pin fastened to a corresponding one of the plurality of first pins, and wherein a total number of second pins of the second connector corresponds to a total number of first pins of the first connector, wherein the second connector is integrally formed through fastening and assembling of the respective second pins to a connector body, wherein each of the respective housings of the small connectors is separated by a spacing, and wherein each of the spacings is sufficiently wide to enable the high-voltage connector assembly to perform high-voltage operations.

2. The separable high-voltage connector assembly of claim 1, wherein the second connector includes a connector body, and wherein each of the second pins is fastened and assembled to the connector body.

3. The separable high-voltage connector assembly of claim 1, wherein each of the second pins is one pin.

4. The separable high-voltage connector assembly of claim 1, wherein each of the plurality of first pins is:

a female pin configured to receive the corresponding second pin, or a male pin configured to be inserted into the corresponding second pin.

5. The separable high-voltage connector assembly of claim 1, wherein each of the respective second pins is a female pin configured to receive the corresponding first pin, or a male pin configured to be inserted into the corresponding first pin.

6. A manufacturing method of a separable high-voltage connector assembly, the manufacturing method comprising:

individually mounting at least three small connectors on a board, each small connector including only one first pin and a respective housing surrounding the first pin, the plurality of small connectors collectively forming a first connector, and none of the respective housings of the small connectors physically contacting one another;

integrally forming a second connector through fastening and assembling a plurality of second pins to a connector body; and fastening the integrally formed second connector to the first connector through fastening each of the plurality of second pins to a corresponding one of the plurality of first pins, wherein each of the respective housings of the small connectors is separated by a spacing, and wherein each of the spacings is sufficiently wide to enable the high-voltage connector assembly to perform high-voltage operations.

7. The manufacturing method of claim 6, wherein the integrally forming of the second connector through fastening and assembling of the respective second pins includes fastening and assembling each of the second pins to a connector body.

8. The manufacturing method of claim 6, wherein each of the second pins is one pin, and wherein the fastening of the second connector including respective second pins to the plurality of first pins includes fastening the one pin of each of the second pins to the plurality of first pins.

* * * * *